US005924133A

United States Patent [19]

Zapiti

[11] Patent Number: 5,924,133

[45] Date of Patent: Jul. 20, 1999

[54] GARMENT FASTENING SYSTEM

[76] Inventor: Mike Zapiti, 29-29 23rd. Ave, Astoria, N.Y. 11105

[21] Appl. No.: 09/113,527

[22] Filed: Jul. 10, 1998

Related U.S. Application Data

[60] Provisional application No. 60/074,238, Feb. 10, 1998.

[51] Int. Cl.[6] ..... A41B 1/00

[52] U.S. Cl. ..... 2/77; 2/96; 2/114; 2/115; 2/913

[58] Field of Search ..... 2/114, 106, 115, 2/118, 234, 236, 913, 914, 919, 227, 128, 96

[56] References Cited

U.S. PATENT DOCUMENTS

| | | | |
|---|---|---|---|
| 4,145,763 | 3/1979 | Abrams et al. | 2/403 |
| 4,422,186 | 12/1983 | Loney | 2/114 |
| 4,561,121 | 12/1985 | Ehring et al. | 2/2 |
| 4,764,986 | 8/1988 | Stewart | 2/115 |
| 5,062,159 | 11/1991 | Jakub | 2/114 |
| 5,097,535 | 3/1992 | Dye et al. | 2/69 |
| 5,133,086 | 7/1992 | Truitt et al. | 2/114 |
| 5,564,123 | 10/1996 | Grassick | 2/69 |
| 5,564,126 | 10/1996 | Chou | 2/114 |
| 5,621,917 | 4/1997 | Howsden | 2/111 |

*Primary Examiner*—John J. Calvert
*Assistant Examiner*—Katherine Moran
*Attorney, Agent, or Firm*—Goldstein & Canino

[57] ABSTRACT

A garment fastening system for use with a pair of pants having a pair of adjoining leg segments joined at a crotch area, a waistband encircling the top opening of the pants which parts at a fly opening, wherein the fly opening consists of adjacent fly flaps, comprising hook and loop fastener strips permanently secured to each of the adjacent fly flaps to help individuals who have a difficulty in manipulating a zipper to dress into or out of the pants. In another embodiment, the garment fastening system is used with a dress shirt consisting of a pair of adjacent shirt halves, and a pair of shirt sleeve having a cuff opening, wherein the cuff opening consists of a pair of adjacent cuff flaps. The garment fastening system comprises a first set of hook and loop fastener segments sized and shaped to appear as standard buttons cooperatively arranged between the edges of shirt halves, and a second set of hook and loop fastener segments cooperatively arranged between the adjacent cuff flaps in such manner as to facilitate the quick and unencumbered opening and closing of the shirt halves and the cuff flaps.

1 Claim, 3 Drawing Sheets

GARMENT FASTENING SYSTEM

CROSS REFERENCES AND RELATED SUBJECT MATTER

This Application relates to subject matter filed on Feb. 10, 1998 in provisional patent application Ser. No. 60/074,238 from which the applicant claims priority.

BACKGROUND OF THE INVENTION

The invention relates to a garment fastening device. More particularly, the invention relates to a device for facilitating easy and effortless fastening of various portions of a garment to other portions of the garment.

Buttons, zippers, and snaps might be a minor annoyance to some people as they dress, but it can make dressing one's self impossible for people suffering from certain disabling conditions. While we take for granted the minimal amount of strength and dexterity necessary to operate a button, snap, or zipper, many people lack the ability to do just that.

A button requires considerable dexterity to operate. One must delicately grasp the button between the thumb and forefinger, work the opposite edge of the button through a slit in the mating garment, and then twist the button until it is fully through the slot and once again parallel to the garment.

Anyone who has ever fastened a sleeve button at the cuff can appreciate the difficulty of buttoning with one hand. Many people only have one useful hand available for such a task. As such, buttoning a shirt can be a time consuming and arduous task.

Zippers also require that the operator have both strength and dexterity. Although not completely necessary, two hands are usually used when zippering—one hand holds the zipper tab, and the other hand tries to maintain the garment halves close together and parallel to facilitate the zippering. Further, it is quite difficult when only using one hand to initially engage the zipper teeth into the slide with a garment such as a jacket.

Snaps are perhaps the worst offender of all the fasteners. Snaps almost always require two hands. One hand is used to push against the snap, while the other presses from behind the opposite portion thereof. Some snaps require considerable strength to engage, or even disengage.

Hook and loop fasteners, commonly sold under the trademark VELCRO is sometimes used in garments and sporting equipment in locations where it is desirable to quickly attach and detach an object to a garment. Hook and loop fasteners have two components: a portion composed of thousands of microscopic thread loops, and a portion composed of thousands of microscopic hooks which selectively engage the loops. A certain force is required to disengage the hooks from the loops. Typically, this force must be applied to only a portion of the hooks at a time to detach the hooks from the loops. Thus, a "peeling" action must be used to detach the hook and loop fasteners. This property gives the hook and loop fasteners considerable strength against perpendicular forces which prevents inadvertent detachment, but allows them to be easily intentionally detached with the proper peeling action. Thus, these fasteners require only minimal strength and dexterity to operate.

Since the hook and loop components are normally backed by fabric, they are easily stitched onto garments. However, similar fasteners are not normally used to replace the most common fasteners used in everyday garments—buttons and zippers.

While these units may be suitable for the particular purpose employed, or for general use, they would not be as suitable for the purposes of the present invention as disclosed hereafter.

SUMMARY OF THE INVENTION

It is an object of the invention to produce a garment fastening device which allows a portion of a garment to be quickly and easily fastened to another portion of the garment, using a fastener which requires only minimal strength and dexterity to operate.

It is another object of the invention that the garment fastener device is used to eliminate the necessity for buttons, snaps, and zippers in a garment. Accordingly, the fastener device is used in the place of the front zipper of pants, in the place of front buttons of a button-down shirt, and in the place of cuff buttons on a shirt sleeve.

It is a further object of the invention that the fastener has considerable strength against perpendicular forces, to resist inadvertent detachment, but which may be easily intentionally detached. Accordingly, the fastener uses hook and loop fastener material which resists detachment from perpendicular forces, but which may be easily detached with a peeling action.

The invention is a garment fastening system for use with a pair of pants having a pair of adjoining leg segments joined at a crotch area, a waistband encircling the top opening of the pants which parts at a fly opening, wherein the fly opening consists of adjacent fly flaps, comprising hook and loop fastener strips permanently secured to each of the adjacent fly flaps to help individuals who have a difficulty in manipulating a zipper to dress into or out of the pants. In another embodiment, the garment fastening system is used with a dress shirt consisting of a pair of adjacent shirt halves, and a pair of shirt sleeve having a cuff opening, wherein the cuff opening consists of a pair of adjacent cuff flaps. The garment fastening system comprises a first set of hook and loop fastener segments sized and shaped to appear as standard buttons cooperatively arranged between the edges of shirt halves, and a second set of hook and loop fastener segments cooperatively arranged between the adjacent cuff flaps in such manner as to facilitate the quick and unencumbered opening and closing of the shirt halves and the cuff flaps.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
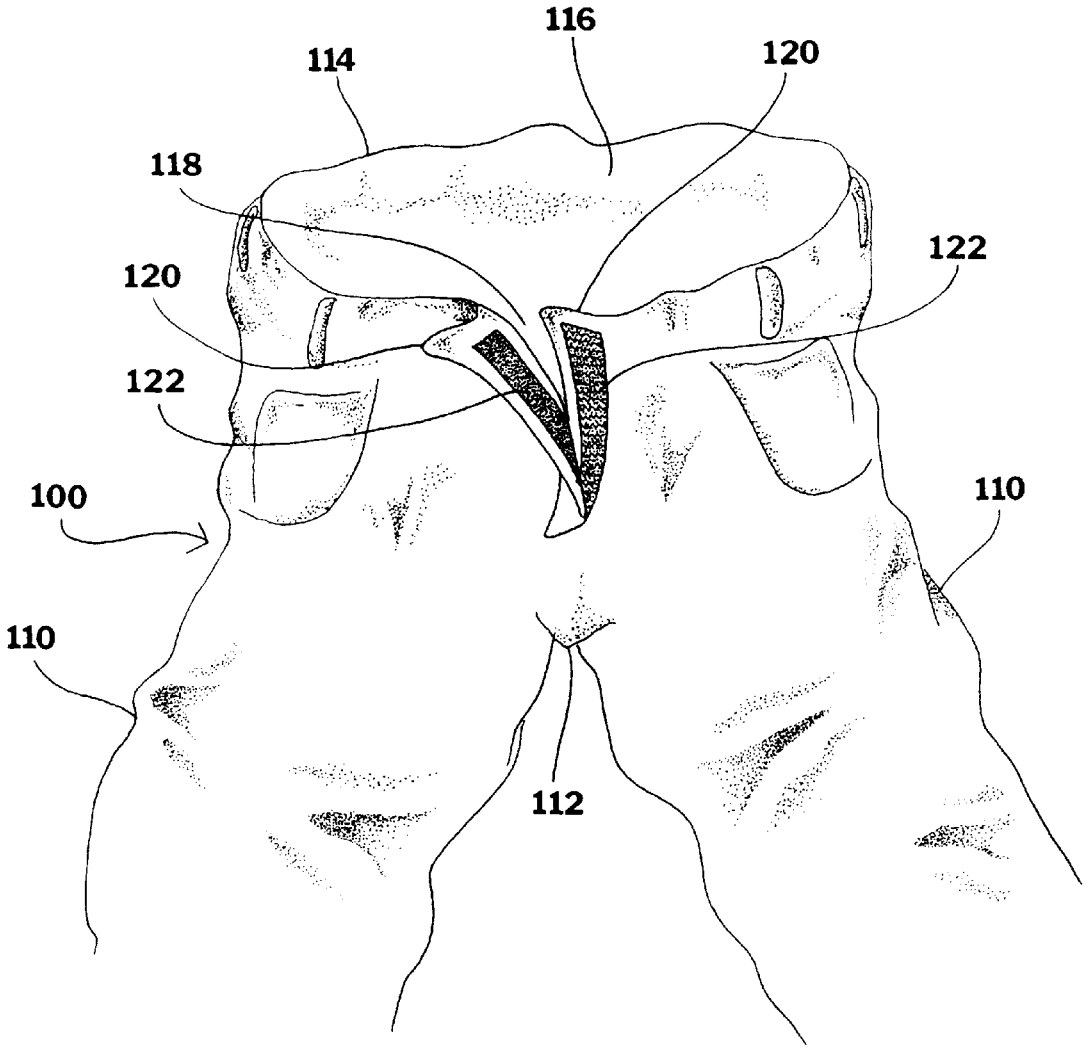
FIG. 1 is a front elevational view, illustrating a pair of pants, employing the present invention to fasten the fly portion thereof.

FIG. 1 is a front elevational view illustrating a pair of pants 100 employing a garment fastening system of the instant invention. As shown, the pants 100 consist of a pair of adjoining leg segments 110 which are co-joined at a crotch area 112. A waistband 114 encircles and defines the top opening 116 of the pants 100, and parts at a fly opening 118. The fly opening 118 consists of adjacent fly flaps 120 which must be secured together after the pants 100 are donned by a wearer. Traditionally, a zipper mechanism (not shown) or series of buttons and matching button holes (also not shown) are utilized to secure said adjacent fly flaps 120 together. Such traditional fastening means require a great amount of dexterity on the part of the user, especially for those users with physical disabilities.

The garment fastening system of the instant invention contemplates replacing traditional snaps, buttons or zippers which were typically employed to secure adjacent fly flaps 120 together with hook and loop fastener strips 122 such as those commonly sold under the trade name VELCRO. A strip 122 of said hook and loop fastener material is permanently secured to each of the adjacent fly flaps 120, so that a user may simply press said flaps 120 together in order to permanently secure one to the other. Not only does this system alleviate any problems encountered by disabled individuals, but it also allows non-disabled wearers to secure their fly opening 118 with one single hand in the event that the other hand is occupied at the time.

Figure 2:
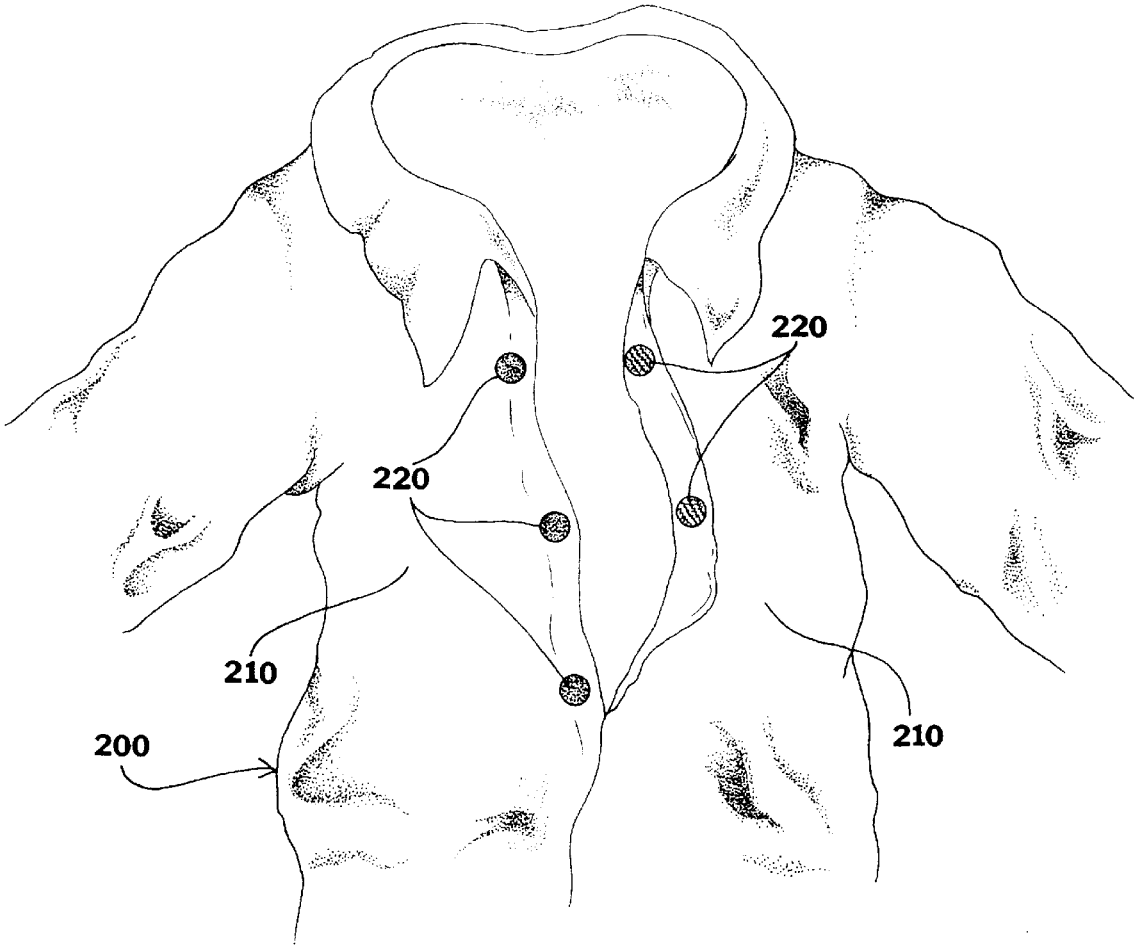
FIG. 2 is a front elevational view, illustrating a button-down shirt, employing the present invention to fasten the plackets thereof.

FIG. 2 illustrates a button down shirt 200, typically consisting of a pair of adjacent shirt halves 210. On standard shirts 200, a series of buttons (not shown) are typically disposed down the edge of one shirt half 210, while correspondingly situated button holes are disposed down the edge of the opposite shirt half 210. As mentioned above, these standard arrangements prove quite difficult for disabled individuals to cope with.

The garment fastening system of the instant invention contemplates replacing the buttons and corresponding button holes typically present on the edges of shirt halves 210 with segments of hook and loop fastener 220 as seen clearly in FIG. 2. These segments 220 may be any shape or size, but are preferably sized and shaped to appear as standard buttons. Not only does this system provide for the simplified fastening of the shirt halves 210 to each other for disabled persons, but it also facilitates the quick and unencumbered opening of said shirt halves 210.

Figure 3:
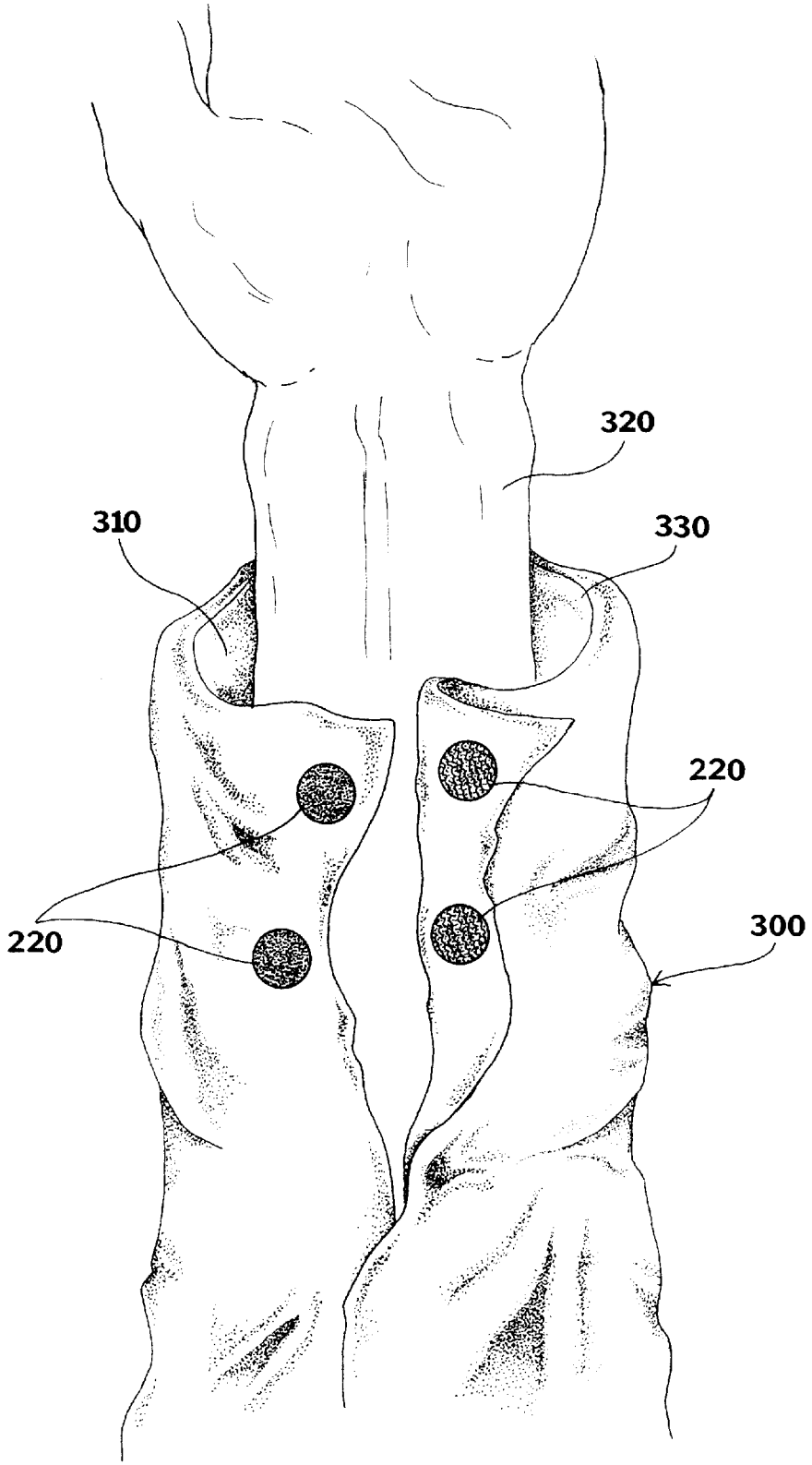
FIG. 3 is a front elevational view, illustrating a shirt sleeve, employing the present invention thereof to fasten the cuff thereof.

FIG. 3 illustrates a shirt sleeve 300. Said shirt sleeve 300 comprises a cuff opening 310 through which a wearer's wrist 320 extends, and a pair of adjacent cuff flaps 330 which, when fastened together, secure the cuff opening 310 about the wearer's wrist 320. In traditional arrangements, buttons and corresponding button holes were employed to accomplish the securement of the adjacent cuff flaps 330 to each other. This arrangement has proven difficult and cumbersome not only to disabled individuals, but to non-disabled persons as well, in that it requires a huge amount of dexterity, skill and patience to accomplish securing one cuff flap 330 to another with the use of only one hand.

The garment fastening system of the instant invention contemplates replacing the buttons and corresponding button holes typically present on the cuff flaps 330 with segments of hook and loop fastener 220 such as those employed on the edges of the shirt halves 210 mentioned above. This arrangement allows the wearer to instantaneously secure the cuff flaps 330 together with single-handed motion.

It should also be understood that the garment fastening system of the instant invention as outlined herein provides a more aesthetically appealing look to the garments upon which it is employed. Rather than obtrusive metal zippers, buttons or snaps being secured to the garment, a more un-obtrusive and uniform length or segment of hook and loop fastener is applied thereto.

What is claimed is:

1. A garment fastening system including a shirt having a pair of adjacent shirt halves on a front portion of the shirt defined in part by vertical edges and a pair of shirt sleeves, wherein each of the sleeves has a cuff opening and a pair of adjacent cuff flaps for securing the cuff opening about a wearer's wrist, comprising a first set of circular shaped hook and loop fastener segments, stitched in spaced intervals along the length of an edge of both shirt halves, cooperatively arranged between the vertical edges of shirt halves in such manner as to facilitate easy opening and closing of the shirt halves and a second set of hook and loop fastener segments cooperatively arranged between the adjacent cuff flaps in such manner as to facilitate easy opening and closing of the cuff flaps.

* * * * *